US005836176A

United States Patent [19]

Lichtenstein et al.

[11] Patent Number: 5,836,176

[45] Date of Patent: Nov. 17, 1998

[54] EARRING ASSEMBLY WITH REMOVABLE ORNAMENTS

[75] Inventors: Joseph Lichtenstein; Israel Lichtenstein, both of Brooklyn, N.Y.

[73] Assignee: Hazel Jewelry Co., Brooklyn, N.Y.

[21] Appl. No.: 857,292

[22] Filed: May 16, 1997

[51] Int. Cl.[6] ..... A44C 7/00

[52] U.S. Cl. ..... 63/13; 63/38; 63/40

[58] Field of Search ..... 63/12, 13, 14.1, 63/20, 21, 22, 23, 38, 40

[56] References Cited

U.S. PATENT DOCUMENTS

| | | | |
|---|---|---|---|
| 1,710,734 | 4/1929 | Johnson | 63/40 |
| 1,899,165 | 2/1933 | Rivet | 63/40 |
| 3,345,830 | 10/1967 | Fontaine | 63/13 |
| 3,526,103 | 9/1970 | Lieber | 63/40 |
| 4,879,883 | 11/1989 | Johnson et al. | 63/4 |

OTHER PUBLICATIONS

1995 Leach & Garner General Findings catalog, pp.16 and 28.

*Primary Examiner*—Kien T. Nguyen
*Attorney, Agent, or Firm*—Kaplan & Gilman, LLP; Michael R. Gilman

[57] ABSTRACT

An improved earring assembly with removable ornaments is provided. The earring assembly comprises an earlobe securing assembly, a pin which hangs from the earlobe securing assembly and at least one selectively removable ornamental member secured to the earring assembly around the pin. The pin has a loop at its first end and a stop at its second end, the loop for receiving therearound the ornamental member(s) and for receiving therethrough a first part of the earlobe securing assembly, and the stop for retaining the ornamental member(s) on the pin. The method of selectively removing the pin from around the earlobe securing assembly for selective removal and replacement of the ornamental member(s) is further provided. Also provided is an earring assembly with a collection of selectively interchangeable ornaments.

23 Claims, 2 Drawing Sheets

EARRING ASSEMBLY WITH REMOVABLE ORNAMENTS

BACKGROUND OF THE INVENTION

This invention relates to the jewelry field, and more particularly, to earrings having removable ornamental members. Jewelry, such as earrings, rings, necklaces, bracelets and watches are old in the art. It is even old in the art for items such as watches to have interchangeable, and usually different colored ring elements for around the face of the watch. This type of interchangeable, differently designed or colored ornament for a watch is fast becoming a trend that even upscale designers are following.

It is also old in the art for customized jewelry items to be made by and/or for a customer. Specifically, the necklaces, bracelets and rings worn by people today are often times the result of the person visiting a jeweler, choosing the stones or ornaments for the piece, and having the jeweler create the piece from the chosen design elements. The layout of these design elements are also often designated by the purchaser. Following this theme, there is also a history of jewelry making children's toys in the market.

The prior art has also seen the advent of numerous different types of add-on or even interchangeable, ornaments for necklaces. In these situations, a person would remove the necklace, and attach around the existing ornamental pieces, wire holders for receipt of additional, and usually different, ornamental pieces.

The earring field has even witnessed its own interchangeable ornamental pieces, but these pieces require the screwing on and off of an end piece; the screwing off of the end piece allows for removal of the existing earring ornamental pieces, and insertion of new earring ornamental pieces, which are then secured by the re-screwing on of the end piece. The disadvantage of these prior art interchangeable earring assemblies is that the screw off pieces are usually very small and are therefore easy to lose, rendering the earring useless. The end pieces can be lost simply by their being dropped during assembly and disassembly of an earring, or, inadvertently, by becoming unscrewed from the main part of the earring and dropping off onto a street, into grass, or any other place where it would be difficult to find such a small part. Additionally, since silver and gold are such malleable materials, there exists the possibility of cross-threading the screw element, which cross-threading would ultimately render useless to the screw element. A final disadvantage of these prior art screw-on, interchangeable earring assemblies is the difficulty of making them, again due to the malleable nature of the metal.

Accordingly, it would be desirable to provide an earring assembly having selectively interchangeable ornamental members, without the risk of losing part of the earring assembly, so as to expand the desire for interchangeability of ornaments from the watch field to the earring field.

SUMMARY OF THE INVENTION

In accordance with the invention, an improved earring assembly with removable ornaments is provided. The earring assembly comprises an earlobe securing assembly, a pin which hangs from the earlobe securing assembly and at least one selectively removable ornamental member secured to the earring assembly around the pin. The pin has a loop at its first end and a stop at its second end, the loop for receiving therearound the ornamental member(s) and for receiving therethrough a first part of the earlobe securing assembly, and the stop for retaining the ornamental member (s) on the pin. The pin is selectively removable from around the earlobe securing assembly for selective removal and replacement of the ornamental member(s).

The invention also comprises a collection of other ornamental members sized to fit the pin and having different ornamental features from each other and from those on the earring assembly.

The invention also comprises the method of removing and replacing ornaments on the earring assembly.

Accordingly, it is an object of the invention to provide an improved earring assembly.

Still another object of the invention is to provide an improved earring assembly having interchangeable ornaments.

Yet a further object of the invention is to provide an improved earring assembly having a pin for holding the interchangeable ornamental members, wherein the pin has a loop sized for both receipt therethrough of a portion of the earlobe securing assembly and receipt therearound of an opening through the ornamental members.

Yet another object of the invention is to provide an improved earring assembly which allows for selective interchangeability of ornamental members, without any screw members.

Still a further object of the invention is to provide an improved earring assembly having a combination therewith a collection of ornamental members interchangeable with the ornamental member(s) of the earring assembly.

A further object of the invention is to provide a method of interchanging ornaments on an earring assembly.

Other objects of the invention will in part be obvious and will in part be apparent from the following description.

The invention accordingly comprises assemblies having the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 2:
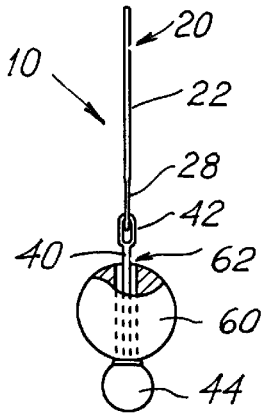
FIG. 2 is a side elevational view showing a partial cutout of the earring assembly.
Figure 3:
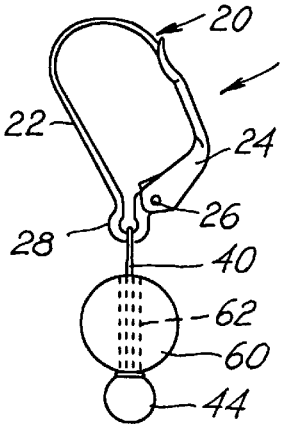
FIG. 3 is a front elevational view of the earring assembly.
Figure 4:
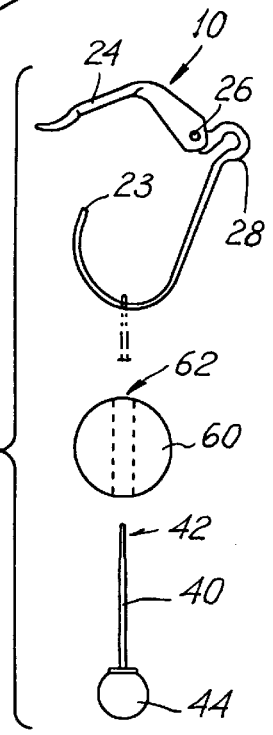
FIG. 4 is an exploded front elevational view of the assembly and disassembly of the earring assembly.

Referring first to FIGS. 2–4, an earring assembly with a selectively removable ornament member made in accordance with the invention and generally designed at 10 is shown. Earring assembly 10 includes earlobe securing assembly 20, pin 40 and at least one ornamental member 60.

Earlobe securing assembly 20 comprises a wire element 22 having a first end 23 (see FIG. 4), a hinge arm 24, pivotable around hinge connection 26, and a defined ornament hanger section 28. First end 23 of wire 22 is the part of earlobe securing assembly 20 which is inserted through the hole in a person's earlobe, so that assembly 10 hangs from the person's ear. In the preferred embodiment, earlobe securing assembly 20 is a lever back assembly, which is known in the earring field. Hinge arm 24 is pivotable about hinge 26 from an open position (see FIG. 4), to a closed position (see FIG. 3).

The invention anticipates the use of other types of earlobe securing assemblies, including ones where hinge 26 is replaced by a spring (not shown), where hinge arm 24 is not included, and instead wire 22 is long enough so that it extends through the person's earlobe and downward so as not to become easily dislodged, or where wire 22 extends in a substantially circular or kidney shaped orientation so that a second end (not shown) substantially meets first end 23 in a closure type assembly. The invention also anticipates use of standard earring backs (not shown), which are those small clamping means received over first end 23 of assembly 10 and held up against the inside of the person's ear for retaining the earring in place. These clamping retention pieces are different from the earlier discussed screw on pieces, since they are not meant to hold the ornamental elements onto the assembly, but are meant to hold the assembly onto the ear.

Continuing with our discussion of earlobe securing assembly 20, hanger section 28 is seen to be a hyper-extended loop element at a second end of wire 22. Section 28 is the preferred form of the invention, since it gives a defined location for hanging of the ornamental elements of assembly 10. Nevertheless, the invention also anticipates no hanger section 28.

As seen in FIG. 2, pin 40 has a loop 42 which receives therethrough wire 22 (see FIG. 4), and comes to rest in hanger section 28 (see FIG. 3).

As seen in FIGS. 2–4, the second end of pin 40 has a stop 44. Stop 44 in one of the preferred embodiments is in the shape of a bulbous member. Stop 44, in the shape of a bulbous member, can be any type of ornamental member, including but not limited to, standard gold balls, other types of metal balls, whether precious or non-precious, or balls made of stones, precious or non-precious.

While one of the preferred embodiments shows stop 44 as a bulbous member, the invention anticipates any shape for stop 44; attention will be directed later to a discussion of the stop of FIGS. 5–7.

Continuing with FIGS. 2–4, ornamental member 60 is seen to be a spherical element having an opening 62 extending therethrough. Ornamental member 60 is anticipated to be any shape, and made from any material, for the purposes of the invention.

Finally, in connection with operating the subject invention, reference is made to FIG. 4. In operation, earring assembly 10 can have its ornamental member (or members—see FIGS. 5–7), changed through the following steps:

1. Opening hinge arm 24 so that first end 23 of wire 22 is exposed;
2. Sliding pin 40 from hanger section 28, along wire 22 until it is removed over end 23;
3. Removing ornamental member 60 from around pin 40, over loop 42;
4. Taking a different ornamental member 82–86 (see FIG. 1), and inserting loop 42 of pin 40 through opening 88 of ornamental members 82–86 (see FIG. 1), so that ornamental members 82–86 rest upon stop 44;
5. Rethreading first end 23 of wire 22 through loop 42 of pin 40 and repositioning loop 42 in hanger section 28 of earlobe securing assembly 20; and
6. Closing hinge arm 24 onto first end 23 of wire 22 for later use of assembly 10, or inserting first end 23 through the hole in one's ear and then closing hinge arm 24.

Now that the manner of assembling and disassembling assembly 10 so as to selectively interchange ornamental members is clear, it is further to be understood by the invention that stop 44 of pin 40 is of a larger size than opening 62 of ornamental member 60. By way of necessity, stop 44 must be larger, either in diameter or some other type of measurement, than opening 62, in order to assure that ornamental member 60 does not become dislodged from assembly 10, except through the above described process of first removing pin 40 from wire 22.

Figure 5:
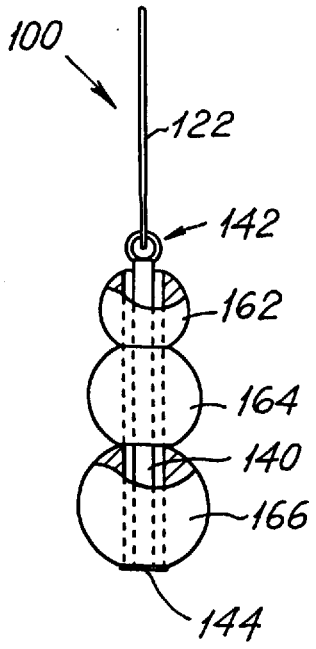
FIG. 5 is a side elevational view of a second embodiment of the earring assembly of the invention.
Figure 6:
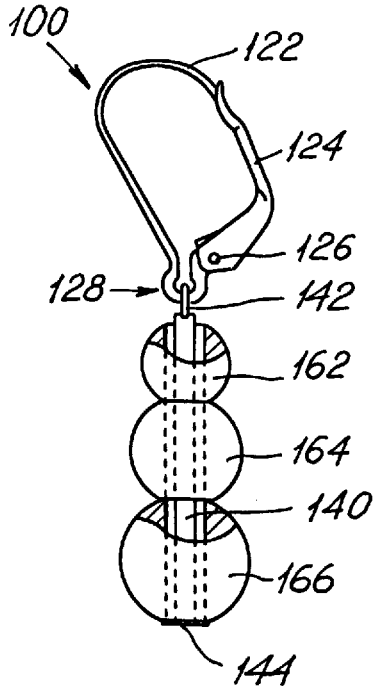
FIG. 6 is a front elevational view of the earring assembly of FIG. 5.
Figure 7:
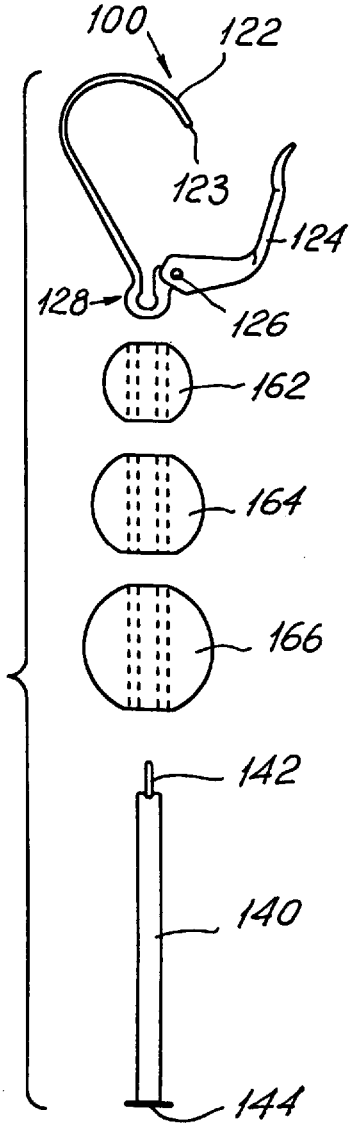
FIG. 7 is an exploded front elevational view of the earring assembly of FIG. 5.

Turning now to a discussion of FIGS. 5–7, a second embodiment of the earring assembly of the invention is shown and described at 100. In this construction of the assembly, all elements are substantially identical, except that pin 140 is longer than pin 40 of assembly 10 in order to accommodate more ornamental members 162, 164 and 166. The other change in assembly 100 from assembly 10, is in the construction of stop 44. As previously discussed, stop 44 of FIGS. 2–4 was a bulbous, ornamental type member, while stop 144 of the embodiment of FIGS. 5–7 is simply a plate. Nevertheless, it is to be understood that even with a longer pin 140 and additional ornamental members, as shown in FIGS. 5–7, the invention would anticipate the use of any type of stop 144, including a bulbous, design-type stop as shown in FIGS. 2–4.

Ornamental members 162, 164 and 166 of FIGS. 5–7 are shown to have different diameters. It is anticipated, however, that these ornamental members can be the same size, and have the same designs or colors thereon, while also anticipating different size and different shape elements, each having a different design or different color. In short, a full gamut of different choice design elements are anticipated by the invention, with the ability of the user to mix and match any ornamental elements which he/she may have in his/her possession.

Figure 1:
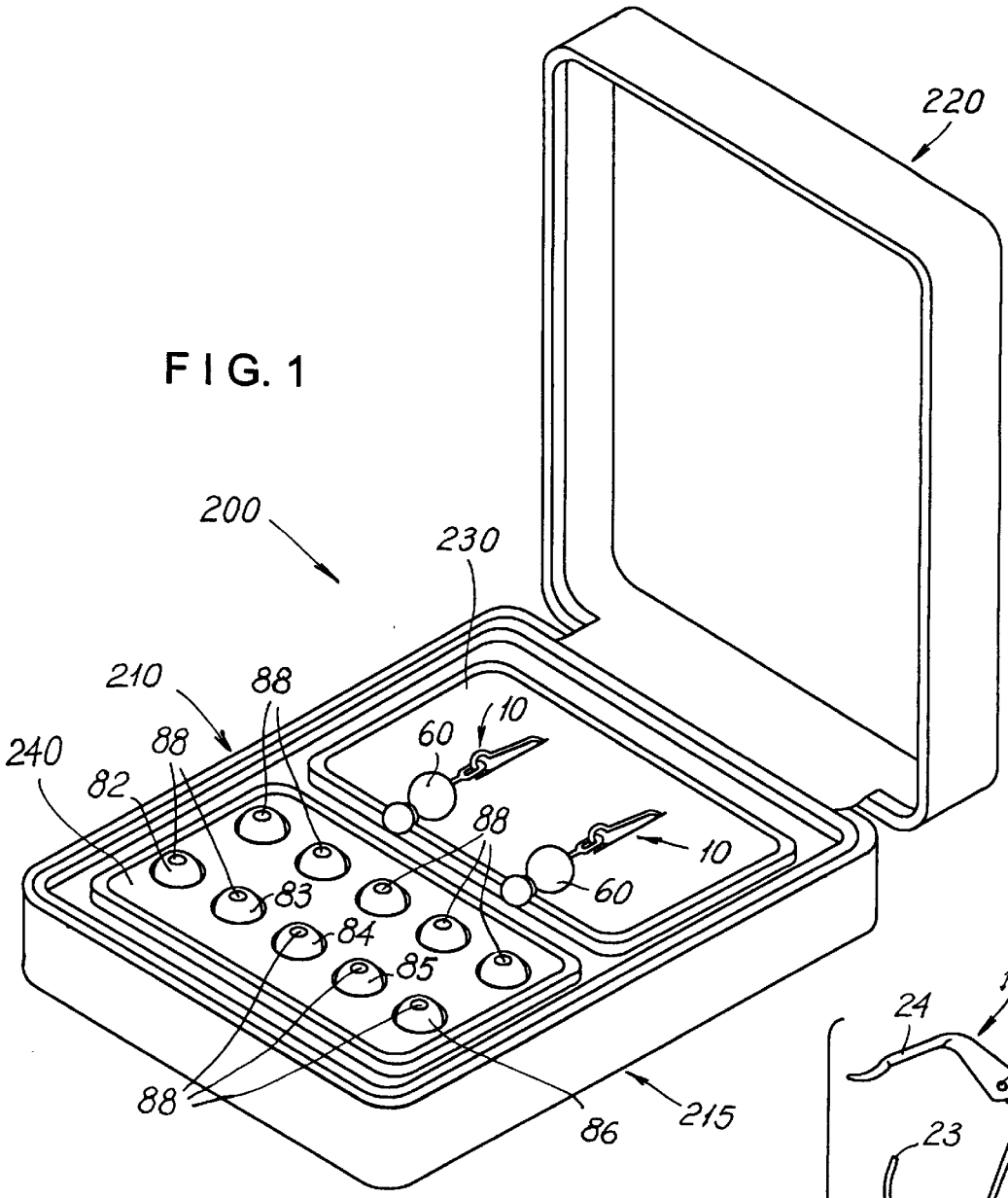
FIG. 1 is a perspective view of the point of sale packaging of the combination earring assembly and collection of other ornamental members.

Turning now to a discussion of FIG. 1, a point-of-sale display package for a pair of earrings made in accordance with the invention is shown at 200. Display 200 includes a box 210 having a base 215 and a lid 220, an earring display plate 230, displaying a pair of earring assemblies 10 (as previously discussed), and display plate 240 showing a plurality of interchangeable ornamental members 82–86. Each of ornamental members 82–86 has an opening 88 extending therethrough.

Although not shown in FIG. 1, and for purposes of further explaining the invention, ornamental members 82 are yellow, ornamental members 83 are blue, ornamental members 84 are red, ornamental members 85 are gold and ornamental members 86 are black. In this way, ornamental members 60, shown on assemblies 10 can be replaced by a pair of ornamental members having a different color scheme, so that each of assemblies 10 can have the same color ornament, or if the user so desires, an ornament of one color (one of ornaments 82) can be used on one assembly, while an ornament of another color (one of ornaments 84) can be used on the other assembly 10, as is seen fit by the user.

It is also anticipated that similar type packaging 200 will be used for the sale of assemblies 100 shown in FIGS. 5–7. It is further anticipated that assemblies 10 and 100 will be sold individually and as sets, without specified collections of other ornamental members 82–86. The user will be able to buy single ornamental members or pairs of ornamental members as he/she sees fit.

It will thus be seen that the objects set forth above, among those made apparent from the preceding description, are efficiently attained, and, since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

We claim:

1. An earring assembly with selectively removable ornaments, comprising:

an earlobe securing assembly;

a pin having a loop at a first end thereof for receiving therethrough a part of said earlobe securing assembly, said pin being selectively slidable around said part of said earlobe securing assembly for selective removability of said pin from said earlobe securing assembly, and a stop at a second end thereof; and at least one ornamental member having at least one opening extending therethrough for receipt of said loop end of said pin, said at least one opening of said at least one ornamental member being smaller then said stop.

2. An earring assembly as recited in claim 1, wherein said earlobe securing assembly is for pierced ears, having a first end sized for receipt through a hole in the earlobe of a person.

3. An earring assembly as recited in claim 2, said first end of said earlobe securing assembly being a substantially thin wire.

4. An earring assembly as recited in claim 3, wherein said loop of said pin is selectively sized for receipt therethrough of said first end of said earlobe securing assembly.

5. An earring assembly as recited in claim 4, said pin in a display position on said earlobe securing assembly at a second end of said earlobe securing assembly.

6. An earring assembly as recited in claim 1, said stop of said pin being fixedly attached at said second end of said pin.

7. An earring assembly as recited in claim 6, said pin having a shaft running between said loop and said stop, said shaft having a length sufficient to hold said at least one ornamental member.

8. An earring assembly as recited in claim 7, said at least one opening through said at least one ornamental member having a diameter capable of receiving said loop and said shaft of said pin.

9. An earring assembly as recited in claim 8, said stop of said pin being a plate having a first side having an area larger than a cross-sectional area of said at least one opening of said at least one ornamental member.

10. An earring assembly as recited in claim 8, said stop of said pin being a bulbous member having a diameter larger than said diameter of said at least one opening of said at least one ornamental member.

11. An earring assembly as recited in claim 8, said stop of said pin being another ornamental member.

12. In combination, an earring assembly, having at least one ornamental member, and a collection of other ornamental members interchangeable with said at least one ornamental member, said earring assembly comprising:

an earlobe securing assembly;

a pin having a loop at a first end thereof for receiving therethrough a part of said earlobe securing assembly, and a stop at a second end thereof;

wherein said at least one ornamental member has at least one opening extending therethrough for receipt of said loop end of said pin, said at least one opening of said at least one ornamental member being smaller than said stop; and said collection of said other ornamental members, comprising a plurality of ornamental members, each having at least one opening extending therethrough for receipt of said loop end of said pin, said at least one opening being smaller than said stop.

13. In combination, an earring assembly and a collection of other ornamental members as recited in claim 12, said pin being selectively slideable around said part of said earlobe securing assembly for selective removability of said pin from said earlobe securing assembly.

14. In combination, an earring assembly and a collection of other ornamental members as recited in claim 13, wherein said earlobe securing assembly is for pierced ears, having a first end sized for receipt through a hole in the earlobe of a person.

15. In combination, an earring assembly and a collection of other ornamental members as recited in claim 14, said first end of said earlobe securing assembly being a substantially thin wire.

16. In combination, an earring assembly and a collection of other ornamental members as recited in claim 15, wherein said loop of said pin is selectively sized for receipt therethrough of said first end of said earlobe securing assembly.

17. In combination, an earring assembly and a collection of other ornamental members as recited in claim 16, said pin in a display position on said earlobe securing assembly at a second end of said earlobe securing assembly.

18. In combination, an earring assembly and a collection of other ornamental members as recited in claim 12, said stop of said pin being fixedly attached at said second end of said pin.

19. In combination, an earring assembly and a collection of other ornamental members as recited in claim 18, said pin having a shaft running between said loop and said stop, said shaft having a length sufficient to hold said at least one ornamental member or at least some of said collection of other ornamental members.

20. In combination, an earring assembly and a collection of other ornamental members as recited in claim 19, said at least one opening through said at least one ornamental member and through each of said collection of other ornamental members, having a diameter capable of receiving said loop and said shaft of said pin.

21. In combination, an earring assembly and a collection of other ornamental members as recited in claim 20, said stop of said pin being a plate having a first side having an area larger than a cross-sectional area of said at least one opening of said at least one ornamental member or of said at least one opening of each of said collection of other ornamental members.

22. In combination, an earring assembly and a collection of other ornamental members as recited in claim 20, said stop of said pin being a bulbous member having a diameter larger than said diameter of said at least one opening of said at least one ornamental member or said at least one opening of each of said collection of other ornamental members.

23. In combination, an earring assembly and a collection of other ornamental members as recited in claim 20, said stop of said pin being another ornamental member.

* * * * *